United States Patent [19]

Mantini

[11] Patent Number: 4,530,531

[45] Date of Patent: Jul. 23, 1985

[54] DEVICE FOR SECURING SLIDING CLOSURES

[76] Inventor: Carl P. Mantini, 4418 Eggars Dr., Freemont, Calif. 94536

[21] Appl. No.: 559,257

[22] Filed: Dec. 8, 1983

[51] Int. Cl.[3] ..... E05C 19/00

[52] U.S. Cl. ..... 292/302; 292/DIG. 46

[58] Field of Search ..... 292/302, 148, 281, 300, 292/175, DIG. 46; 70/164, 57, 58

[56] References Cited

U.S. PATENT DOCUMENTS

| | | | |
|---|---|---|---|
| 716,118 | 12/1902 | Scott | 292/300 |
| 966,780 | 8/1910 | Thomas | 292/175 |
| 1,554,592 | 9/1925 | Olson | 292/281 |
| 1,979,928 | 11/1934 | Bakke | 292/148 X |
| 4,379,576 | 4/1983 | Blough et al. | 292/300 X |

*Primary Examiner*—Richard E. Moore

*Attorney, Agent, or Firm*—Wood, Dalton, Phillips, Mason & Rowe

[57] ABSTRACT

A device for securing sliding closures such as a door or window slidable in an appropriate track in a frame. First and second latch sections are provided, one securable to the closure and the other securable to the frame by appropriate fasteners. The latch sections have complementary walls defining a substantially closed compartment which conceals the fasteners when the closure is in a closed position relative to the frame. The latch sections prevent the closure from being lifted out of the track.

21 Claims, 9 Drawing Figures

FIG. 1
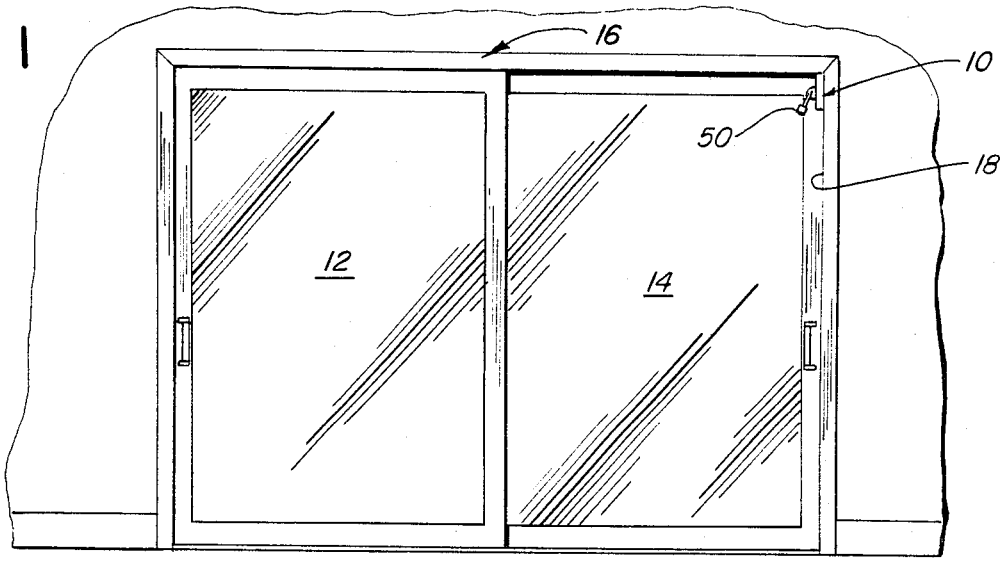
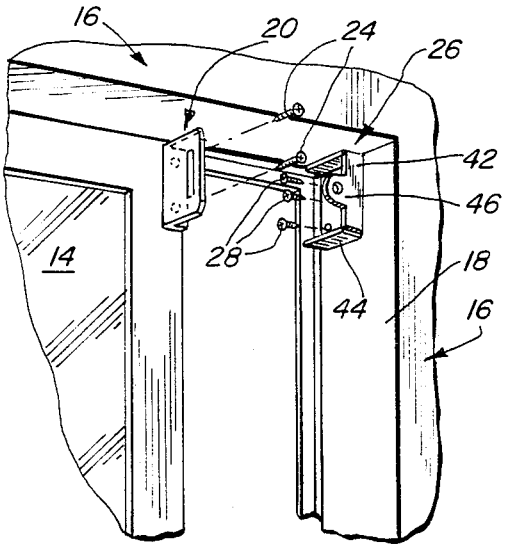
FIG. 2
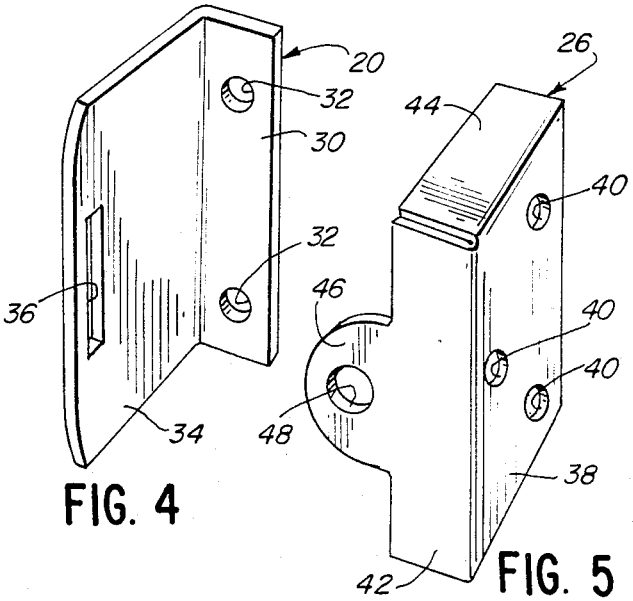
FIG. 4
FIG. 5
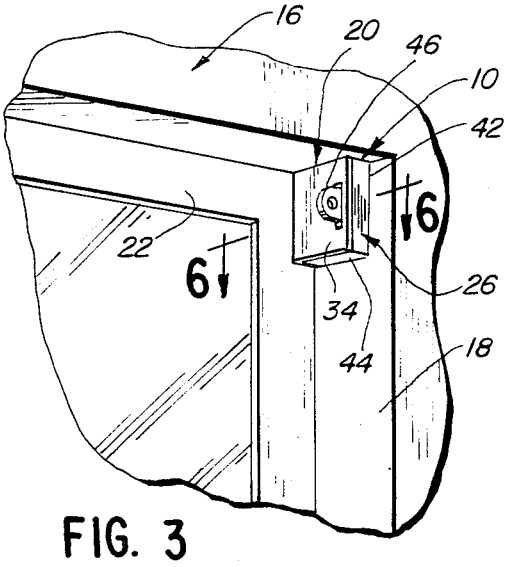
FIG. 3
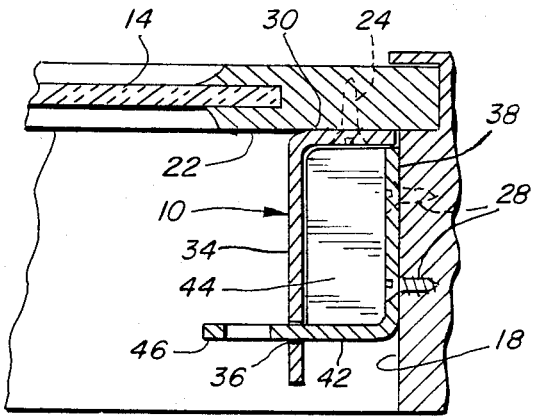
FIG. 6

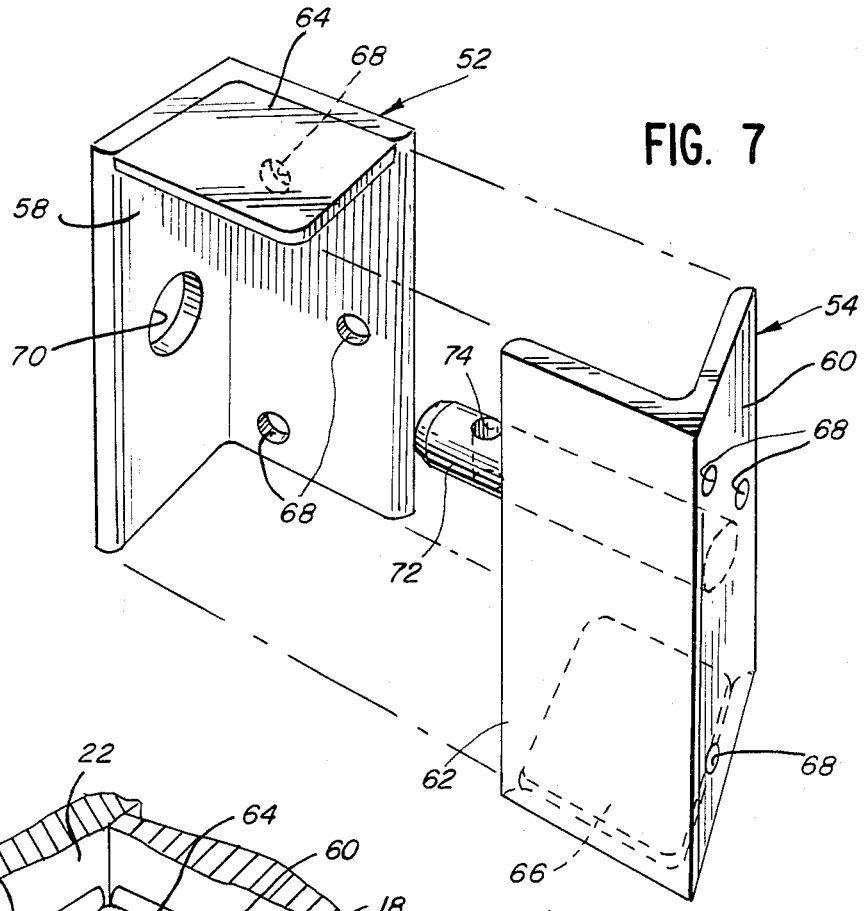
FIG. 7
FIG. 8
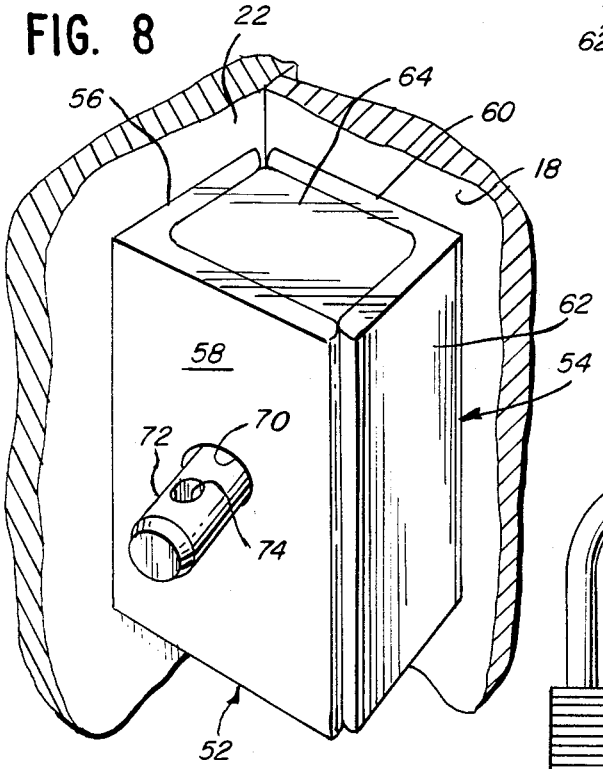
FIG. 9
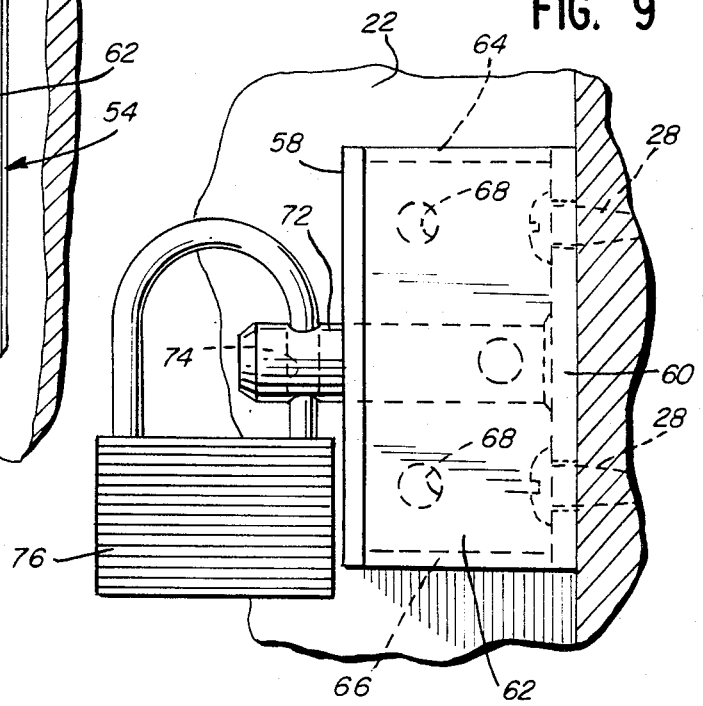

DEVICE FOR SECURING SLIDING CLOSURES

BACKGROUND OF THE INVENTION

This invention relates to locking structures and particularly to a device for securing sliding closures, such as a door or window which slides in an associated track in a frame.

Door closure constructions, including sliding doors, panels windows or the like, usually have primary lock means operable from either inside or outside of the closure. The primary lock means may be capable of being opened by unwanted intruders using master keys or lock picking tools. such intrusions have been deterred by employing secondary securement locks which are capable of actuation only from within the closure building or house.

Over the last several decades building practices often have included sliding glass doors and large area sliding glass windows as a means for allowing visual communication as well as bodily passage between the interior of home, for instance, and the out-of-doors. Often such closures constitute two glass doors, one of which is stationary and the other of which is slidable upon a horizontal track. Both doors or closures usually fit within the track and, in some instances, both doors are removable from the track. The primary lock means usually supplied with such closures unfortunately have been subject to easy opening by unauthorized intruders. Forced entry through such cloures is commonplace and constitutes the usual mode of unauthorized entry into those housing structures fitted with such closures. Often the unauthorized entry is accomplished simply by lifting one or the other of the closures out of its track, in addition to defeating the primary lock means. Consequently, the secondary securement locks have been employed for actuation only from within the door closure building or house.

However, often a thief will enter a house or building through a front entry or garage where the locking systems are easily defeated. Larger stolen items or applicances are more easily removed from the house through a rear entry where large sliding doors and large area sliding glass windows normally are disposed. In such instances, the secondary locks are of little avail because they normally are fastened to the door face and the surrounding door frame or jamb and can be readily dismantled therefrom simply by loosening the fastening means.

The present invention is directed to solving the aforesaid problems by providing a locking system which employs a singular device which not only prevents the sliding door from being lifted off of its track, but the device conceals the means by which it is fastened to the sliding door and the door frame.

SUMMARY OF THE INVENTION

An object, therefore, of the invention is to provide a new and improved device for securing sliding closures such as a door or window slidable in appropriate track means in a frame.

Another object of the invention is to provide a device of the character described which conceals the means for fastening the device to the door and door frame.

A further object of the invention is to provide a device of the character described which prevents lifting the door out of its associated sliding track.

In the exemplary embodiment of the invention, a device is disclosed for securing sliding closures, such as a door or window, which slide in associated track means in a door frame into a closed position against a doorjamb. A first latch section is securable to the face of the sliding door by appropriate fasteners. A second latch section is securable to the doorjamb by appropriate fasteners. Complementary interlock means is disposed between the first and second latch sections for facilitating securing the latch sections and locking the door to the doorjamb when the latch sections are joined in the closed position. The first and second latch sections have complementary wall means defining a substantially closed compartment which conceals the fasteners when the latch sections are joined.

In the embodiments disclosed herein, the latch section are formed of sheet metal material to define a generally rectangular closed compartment when joined. Each latch section includes a base wall or portion securable to the respective door and doorjamb and side walls projecting from the base walls and cooperating to define the closed compartment. More particularly, the latch section which is secured to the face of the door includes a side wall projecting outwardly from the base wall thereof in spaced relationship to the doorjamb when the door is in closed position. The latch section which is secured to the doorjamb includes a side wall projecting outwardly from the base wall thereof in spaced relationship to the face of the door. When the door is in closed position and the latch sections joined, the side walls form sides of the rectangular closed compartment.

The projecting side wall of the latch section secured to the face of the door is perforate for receiving an interlocking projection on the latch section secured to the doorjamb. In one form of the invention, the projecting side wall of the latch section secured to the doorjamb includes an interlocking projection extending through the perforate side wall of the other latch section when joined. In another form of the invention, a post extends outwardly from the latch section secured to the doorjamb and through the perforate side wall of the other latch section when joined. In either embodiment, the interlocking projection includes means for receiving a padlock or similar element to lock the latch sections in joined condition. A sufficiently close fit is provided between the interlocking projection of the latch section secured to the doorjamb and the perforate side wall of the latch section secured to the face of the door to prevent lifting the door out of its associated track.

Thus, the above-described singular securing device performs both functions of concealing the means for fastening the device in position as well as preventing the closure from being lifted out of its sliding track.

Other objects, features and advantages of the invention will be apparent from the following detailed description taken in connection will the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is an elevational view looking at the inside of a sliding closure construction employing the securing device of the invention in the upper righthand corner thereof;

FIG. 2 is a fragmented perspective view, on an enlarged scale, of the securing device in the upper right-hand corner of FIG. 1, with the closure slightly ajar to reveal the concealed fastening means;

FIG. 3 is a view similar to that of FIG. 2, with the door and securing device in closed condition;

FIG. 4 is a perspective view, on an enlarged scale, of the first latch section of the device securable to the face of the closure;

FIG. 5 is a perspective view, on an enlarged scale, of the second latch section of the securing device securable to the doorjamb;

FIG. 6 is a section, on an enlarged scale, taken generally along line 6—6 of FIG. 3;

FIG. 7 is a perspective view of the two latch sections of an alternate form of the securing device of the invention in separated condition;

FIG. 8 is a perspective view of the device of FIG. 7 with the latch sections joined; and FIG. 9 is a front elevational view of the joined device of FIG. 8, with a padlock in position securing the device.

DETAILED DESCRIPTION OF THE PREFERRED EMBODIMENT

Referring to the drawings in greater detail, and first to FIG. 1, the securing device of the invention is generally designated 10 and is illustrated located in the upper right-hand corner of a door closure construction. The door closure construction is conventional and includes a pair of large glass doors 12 and 14 mounted within a door frame, generally designated 16. Such closures typically include the two glass doors wherein one of the doors, such as door 12, is stationary or fixed, and the other door, such as door 14, is slidable in a horizontal sense upon a track extending along the base of the closure. Sliding door 14 moves in the track into a closed position as shown in FIG. 1 against a doorjamb 18 of door frame 16. Of course, it should be understood that securing device 10 of this invention can be used with multiple sliding door closure constructions, as well as sliding panels, windows or the like.

Referring to FIG. 2, securing device 10 includes a first latch section, generally designated 20, securable to the face 22 of the frame surrounding glass door 14 by appropriate fasteners which are illustrated as screws 24. A second latch section, generally designated 26, is securable to doorjamb 18 of door frame 16 by appropriate fasteners illustrated as screws 28.

Securing device 10 is constructed in a manner to form a substantially closed compartment which conceals fasteners 24, 28 when the latch sections are joined as illustrated in FIGS. 3 and 6. It particularly can be seen in FIG. 3 that the joined latch sections 20 and 26 form a rectangular enclosure which prevents any access whatsoever to fastening screws 24 and 26, completely concealing the fasteners when the latch sections are joined when door 14 is in closed condition against doorjamb 18. This also can be seen by the sectional view shown in FIG. 6.

More particularly, as illustrated in FIGS. 4–6, first latch section 20 which is securable to the face of door 14 includes a base portion or wall 30 securable directly to the face of the door. Base wall 30 has apertures 32 through which fastener screws 24 extend. A side wall 34 projects at a right angle outwardly from base wall 30. Side wall 34 is imperforate by the provision of a vertically oriented slot 36. It can be seen in FIG. 6 that side wall 34 is in spaced relationship to doorjamb 18 when the latch sections are joined with door 14 in closed position.

Second latch means 26 includes a base portion or wall 38 securable directly to doorjamb 18 and includes apertures 40 through which fastener screws 28 extend. A side wall 42 projects outwardly at a right angle to base wall 38 and forms the front of the security device. Second latch section 26 also includes a pair of end walls 44 which define the top and bottom of the security device. Thus, it can be seen that side wall 34 of first latch section 20 and side wall 42 and end walls 44 of second latch section 26 combined with the respective base walls 30 and 38 of the latch sections to define a closed compartment which conceals fasteners 24, 28 when the latch sections are joined as shown in FIGS. 3 and 6.

Complementary interlock means are provided between thee first and second latch sections for facilitating securing the latch sections and locking door 14 to doorjamb 18 when the latch sections are joined in the closed position of the door. More particularly, a projecting tab 46 is formed integral with side wall 42 of second latch section 26 for projecting through slot 36 of side wall 34 of first latch section 20 when the latch sections are joined as shown in FIGS. 3 and 6. The projecting tab portion includes an aperture 48 for receiving a padlock 50 (FIG.1) or similar locking element to lock the latch sections in their joined condition. It should be noted that the length of slot 36 in first latch section 20 is sized to have a sufficiently close fit with projecting tab 46 of second latch section 20 to prevent lifting door 14 out of its associated sliding track. This is important should the securing device 10 be positioned other than in the extreme corner as shown in the figures. In other words, first latch section 20, when secured in the extreme upper position shown in FIGS. 2 and 3, will itself abut against the top of door frame 16 to prevent lifting the door out of the track.

FIGS. 7–9 illustrate an alternate embodiment which incorporates the novel concepts of the invention. More particularly, a first latch section, generally designated 52 is securable to the face of door 14, and a second latch section, generally designated 54, is securable to doorjamb 18, similar to latch sections 20 and 26 of the embodiment illustrated in FIGS. 1–6.

In the alternate embodiment, lengths of angled sheet material are employed to fabricate the latch sections in substantially identical fashion, except for the complementary interlock means between the latch sections. More particularly, as best seen in FIGS. 7 and 8, first latch section 52 has a unitary angle portion which defines a base wall 56 and a side wall 58 similar to base wall 30 and side wall 34 of first latch section 20. Second latch section 54 has an angle portion which defines a base wall 60 and a side wall 62 similar to base wall 38 and side wall 42 of second latch section 26. First latch section 52 has an end wall 64 and second latch section 54 has an end wall 66. To this extent, both the first and second latch sections 52 and 54, respectively, are fabricated identically. In addition, identical apertures 68 are formed in base walls 56 and 60 for receiving appropriate fasteners, such as screw fasteners 24, 28.

In the embodiment of FIGS. 7–9 the interlock means between the first and second latch sections comprises an enlarged aperture 70 in side wall 58 of first latch section 52 for receiving a rod 72 fixed, as by welding, to the inside of base wall 60 of second latch section 54 and projecting generally perpendicularly outwardly therefrom. The projecting rod has a generally vertical bore 74 for receiving a padlock 76 or similar locking element to lock the latch sections in joined condition as illustrated in FIGS. 8 and 9. The diameter of bore 74 is sized to have a sifficiently close fit with rod 72 to prevent lifting the door out of its associated sliding track.

It can be seen in FIGS. 8 and 9 that the embodiment illustrated therein includes two latch sections with wall means, as described above, which define a substantially closed compartment for concealing the fastening means when the latch sections are joined, similar to the operation and function of the first embodiment described above in relation to FIGS. 1–6.

Thus, it can be seen that I have provided a new and improved device for securing sliding closures such as a door or window slidable in appropriate track means in a door frame, wherein the device is effective to conceal and prevent access to the fastening means which secures the device to the respective door or door frame. In addition, the device is such as to prevent lifting the door out of its respective track when the device is in secured condition.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein:

What is claimed is:

1. A device for securing closures such as a door which moves in a door frame into a closed position against a doorjamb, comprising:

a first latch section securable to the face of said door;

fastening means for securing said first latch section to the face of said door;

a second latch section securable to said doorjamb;

fastening means for securing said second latch section to said doorjamb;

complementary interlock means between said first and second latch sections for facilitating securing the latch sections and locking the door to the doorjamb when the latch sections are joined in said closed position; and one of said first and second latch sections having wall means projecting outwardly from the respective door face and doorjamb in spaced relationship to the other of said door face and doorjamb and cooperating with the other latch section to define a substanially closed compartment on the exterior of the door when the door is in said closed position which conceals said fastening means when the latch sections are joined.

2. The device of claim 1 wherein each of said latch sections includes a base portion securable to the respective door and doorjamb and side walls projecting from said base portions and cooperating to define said closed compartment.

3. A device for securing closures such as a door which moves in a frame into a closed position against a doorjamb, comprising:

a first latch section having a base portion securable to the face of said door;

fastening means for securing the base portion of said first latch section to the face of said door;

a second latch section including a base portion securable to said doorjamb;

fastening means for securing the base portion of said second latch section to said doorjamb;

complementary interlock means between said first and second latch sections for facilitating securing the latch sections and locking the door to the doorjamb when the latch sections are joined in said closed position; and said first and second latch sections having complementary wall means including side walls projecting from said base portions and cooperating to define a substantially closed compartment which conceals said fasteners when the latch sections are joined, said side walls including a side wall projecting outwardly from the base portion of said first latch section in spaced relationship to the doorjamb when the door is in said closed position, said side wall forming one side of said closed compartment and including part of said complementary interlock means.

4. The device of claim 3 wherein said second latch section includes a side wall projecting outwardly from the base portion thereof in spaced relationship to the face of the door when in said closed position and forming another side of said closed compartment.

5. The device of claim 4 wherein said side wall of the second latch section includes a second part of said complementary interlock means.

6. The device of claim 5 wherein said side wall of the first latch section is imperforate for receiving an interlocking projection on the second latch section.

7. The device of claim 6 wherein said interlocking projection of the second latch section is sufficiently close fit within the imperforate side wall of the first latch section to prevent lifting the door.

8. The device of claim 7 wherein said interlocking projection includes means for receiving a padlock or similar element to lock the latch sections in joined condition.

9. A device for securing closures such as a door or window movable in a frame, comprising: first and second latch means, one securable to the closure and the other securable to the frame, fastening means for securing the first and second latch means to their respective closure and frame, said first and second latch means having complementary wall means with at least one side wall of one of said latch sections projecting outwardly from at least one of the closure and frame in spaced relationship with the other, said complementary wall means defining a substantially closed compartment on the exterior of the door when the door is in said closed position which conceals said fastening means when the closure is in a closed position relative to the frame.

10. The device of claim 9 wherein each of said first and second latch means includes a base portion securable to the respective closure and frame by said fasteners, and side walls projecting from said base portions and cooperating to define said closed compartment.

11. A device for securing closures such as door or window movable in a frame, comprising: first and second latch means each including a base portion respectively securable to one of the closure and the frame, fastening means for securing the base portions of said first and second latch means to their respective closure and frame, said first and second latch means having complementary wall means including side walls projecting from said base portions and cooperating to define a substantially closed compartment which conceals said fastening means when the closure is in a closed position relative to the frame, said side walls including a side wall projecting outwardly from the base portion of said first latch means in spaced relationship to the frame when the closure is in said closed position, said side wall forming one side of said closed compartment.

12. The device of claim 11 wherein said second latch means is securable to the frame and includes a side wall projecting outwardly from the base portion thereof in spaced relationship to the closure when in said closed position and forming another side of said closed compartment.

13. The device of claim 12 wherein said side walls of said first and second latch means include complementary interlock means for facilitating securing the latch means when joined in said closed position.

14. The device of claim 12 wherein said side wall of the first latch means is perforate for receiving an interlocking projection on the second latch means.

15. The device of claim 14 wherein said interlocking projection of the second latch means is sufficiently close fit within the perforate side wall of the first latch means to prevent lifting the closure.

16. The device of claim 15 wherein said interlocking projection includes means for receiving a padlock or similar element to lock the first and second latch means in joined condition.

17. The device of claim 14 wherein said interlocking projection is formed as part of said side wall of said second latch means.

18. The device of claim 14 wherein said interlocking projection projects outwardly of the base portion of said second latch means.

19. A device for securing closures such as a door or window movable in a frame, comprising: first and second latch means fabricated of sheet metal, one securable to the closure and the other securable to the frame, fastening means for securing the first and second latch means to their respective closure and frame, said first and second latch means having complementary wall means defining a polygonal closed compartment which conceals said fastening means when the closure is in a closed position relative to the frame.

20. A device for securing closures such as a door which moves in a frame into a closed position against a doorjamb, comprising:

a first latch section having a base portion securable to the face of the said door;

fastening means for securing the base portion of said first latch section to the face of said door;

a second latch section including a base portion securable to said doorjamb;

fastening means for securing the base portion of said second latch section to said doorjamb;

complementary interlock means between said first and second latch sections for facilitating securing the latch sections and locking the door to the doorjamb when the latch sections are joined in said closed position; and said first and second latch sections having complementary wall means including side walls projecting from said base portions and cooperating to define a substantially closed compartment which conceals said fasteners when the latch sections are joined, said side walls including a side wall projecting outwardly from the base portion of said second latch section in spaced relationship to the face of the door when in said closed position and forming one side of said closed compartment.

21. A device for securing closures such as door or window movable in a frame, comprising: first and second latch means each including base portions respectively securable to one of the closure and the frame, fastening means for securing the base portions of said first and second latch means to their respective closure and frame, said first and second latch means having complementary wall means including side walls projecting from said base portions and cooperating to define a substantially closed compartment which conceals said fastening means when the closure is in a closed position relative to the frame, said side walls including a side wall projecting outwardly from the base portion of said second latch means in spaced relationship to the closure when in said closed position and forming one side of said closed compartment.

* * * * *